US007566242B2

(12) United States Patent
Zhu et al.

(10) Patent No.: US 7,566,242 B2
(45) Date of Patent: Jul. 28, 2009

(54) ELECTRICAL CONNECTOR WITH IMPROVED CONTACTS

(75) Inventors: Zi-Qiang Zhu, Kunshan (CN); Hong-Qiang Han, Kunshan (CN); Li-Qiang Yao, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/074,298

(22) Filed: Mar. 3, 2008

(65) Prior Publication Data

US 2008/0214061 A1 Sep. 4, 2008

(30) Foreign Application Priority Data

Mar. 2, 2007 (CN) ..... 2007 2 0034861

(51) Int. Cl.
*H01R 13/434* (2006.01)

(52) U.S. Cl. ..... 439/567; 439/188; 439/733.1

(58) Field of Classification Search ..... 439/63, 439/80, 82, 188, 439, 567, 580, 733.1, 751, 439/752

See application file for complete search history.

(56) References Cited

U.S. PATENT DOCUMENTS

| | | | | |
|---|---|---|---|---|
| 3,949,180 | A | 4/1976 | Ojima et al. | |
| 4,426,558 | A | 1/1984 | Tanaka et al. | |
| 4,666,231 | A | 5/1987 | Sheesley et al. | |
| 4,735,587 | A * | 4/1988 | Kirayoglu | 439/751 |
| 4,857,001 | A * | 8/1989 | Nakano et al. | 439/68 |
| 4,937,404 | A | 6/1990 | Kitagawa et al. | |
| 5,120,257 | A * | 6/1992 | Hahn | 439/567 |
| 5,183,405 | A * | 2/1993 | Elicker et al. | 439/108 |
| 5,409,399 | A * | 4/1995 | Geoghegan et al. | 439/567 |
| 5,411,404 | A * | 5/1995 | Korsunsky et al. | 439/108 |
| 5,462,444 | A * | 10/1995 | Korsunsky et al. | 439/108 |
| 5,944,538 | A | 8/1999 | Sorig | |
| 6,695,644 | B2 * | 2/2004 | Zhao et al. | 439/580 |
| 6,733,334 | B2 * | 5/2004 | Chen | 439/554 |
| 6,793,541 | B2 * | 9/2004 | Yamaguchi et al. | 439/751 |
| 7,094,088 | B2 | 8/2006 | Wang et al. | |
| 7,101,200 | B1 * | 9/2006 | Harlan et al. | 439/108 |
| 2008/0214061 | A1 * | 9/2008 | Zhu et al. | 439/733.1 |

* cited by examiner

*Primary Examiner*—James Harvey
(74) *Attorney, Agent, or Firm*—Wei Te Chung

(57) ABSTRACT

An electrical connector mounted on a printed circuit board including an insulative housing (1) provided with a receiving cavity (16) and a number of passageways (121), and a number of contacts retained in the housing. The contacts have a first contact (21) including a first base portion (210) and a first soldering portion (213) extending downwardly from the first base portion, a second contact (22) having a second base portion (220) and a second soldering portion (223) extending downwardly from the second base portion. The first soldering portion includes a first protrusion portion (216) projecting from only one side edge thereof along a first direction. The second soldering portion includes a second protrusion portion (226) projecting from only one side edge thereof along a second direction opposite to the first direction. The first protrusion portion and the second protrusion portion together form a latch portion for fixing with the printed circuit board.

9 Claims, 9 Drawing Sheets

ELECTRICAL CONNECTOR WITH IMPROVED CONTACTS

BACKGROUND OF THE INVENTION

1. Field of the Invention

The present invention generally relates to an electrical connector and more particularly to an electrical connector having improved contacts.

2. Description of Related Art

A conventional audio jack is usually used in electrical equipments such as stereo audio equipment, mobile phones and the like for contacting with a mating plug. The audio jack is mounted on a printed circuit board, and comprises an insulative housing defining a front mating face and a receiving cavity extending through the insulative housing, and a plurality of contacts retained in the receiving cavity. The contacts include two types of soldering legs inserted into corresponding solder holes of the printed circuit board, wherein, the first type of the soldering legs is bent downwardly and vertically without any protrusion portion formed thereon. The other type of the soldering legs is provided with a protrusion portion on a distal end thereof, the protrusion portion is folded outwardly and then inwardly to be elastic, such that the protrusion portion is inserted into the solder hole and elastically biases against inner walls of the solder hole to secure the soldering leg within the solder hole, however, the process of manufacturing the protrusion portion is complicated and the dimension of the protrusion portion is difficult to be made precise.

It is thus desired to provide an electrical connector having an improved soldering portion.

SUMMARY OF THE INVENTION

According to the present invention, an electrical connector mounted on a printed circuit board including: an insulative housing having a receiving cavity and a plurality of passageways; a plurality of contacts retained in the passageways respectively, including: a first contact having a first base portion and a first soldering portion extending downwardly from the first base portion, the first soldering portion defining a first protrusion portion projecting from only one side edge thereof along a first direction; a second contact having a second base portion and a second soldering portion extending downwardly from the second base portion, the second soldering portion defining a second protrusion portion projecting from only one side edge thereof along a second direction opposite to the first direction; the first protrusion portion and the second protrusion portion together form a latch portion to fix the first contact and the second contact to the printed circuit board.

Other objects, advantages and novel features of the present invention will become more apparent from the following detailed description of the present embodiment when taken in conjunction with the accompanying drawings.

DETAILED DESCRIPTION OF THE INVENTION

Figure 1:
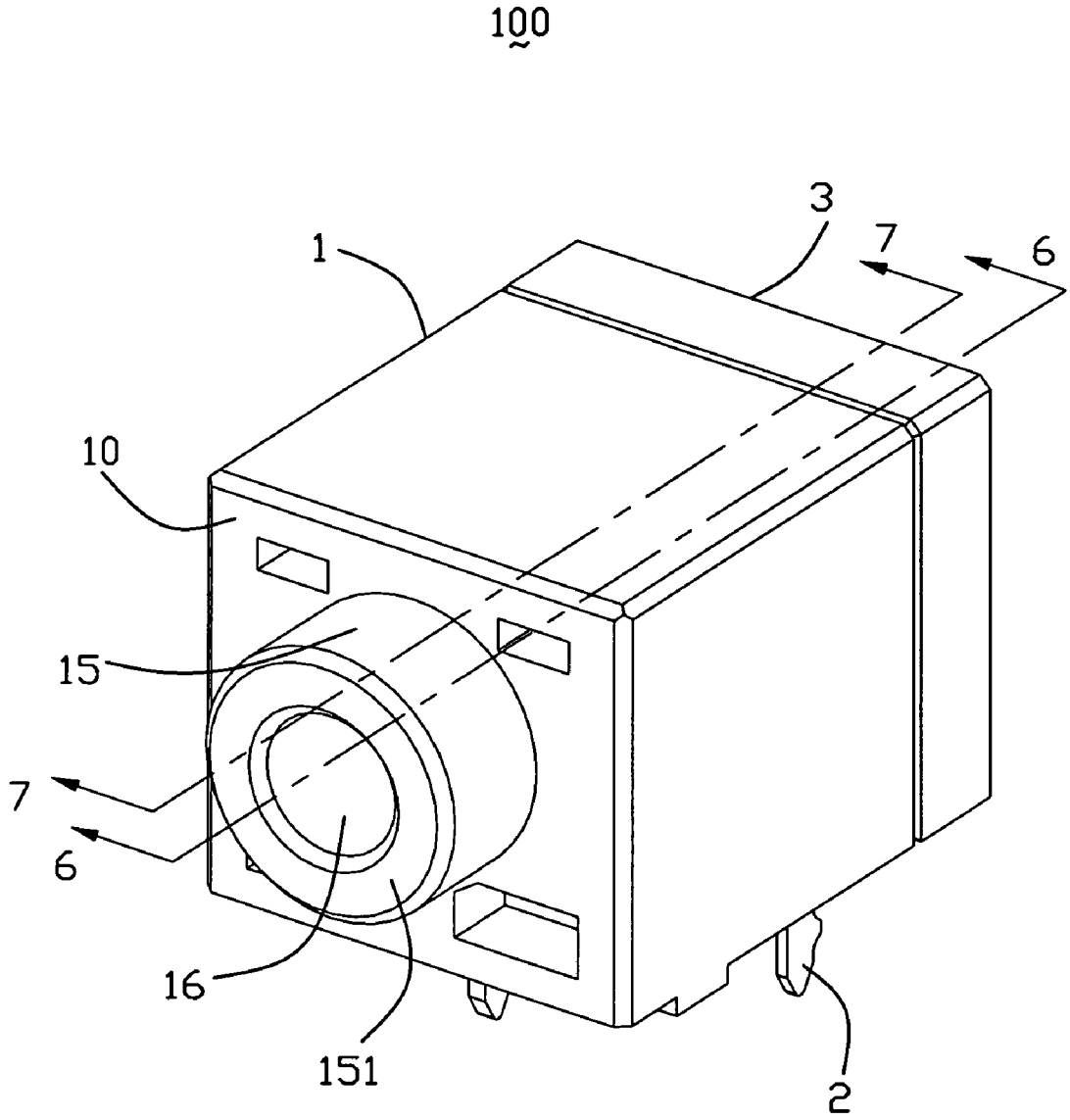
FIG. 1 is an assembled perspective view of an electrical connector according to the present invention.

Reference will now be made to the drawing figures to describe the preferred embodiment of the present invention in detail.

Figure 2:
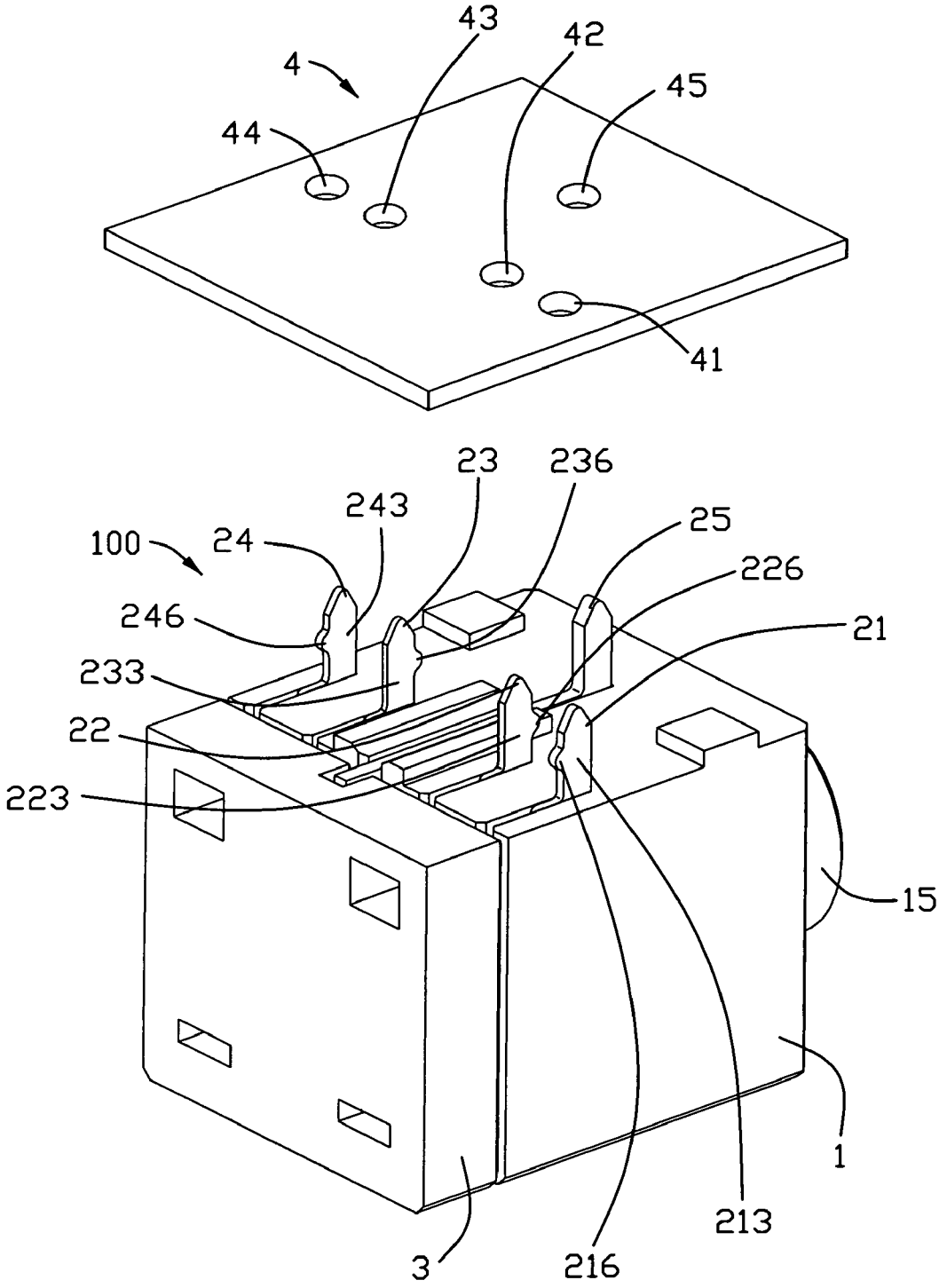
FIG. 2 is a bottom view of the electrical connector and a printed circuit board for mating with the electrical connector.
Figure 3:
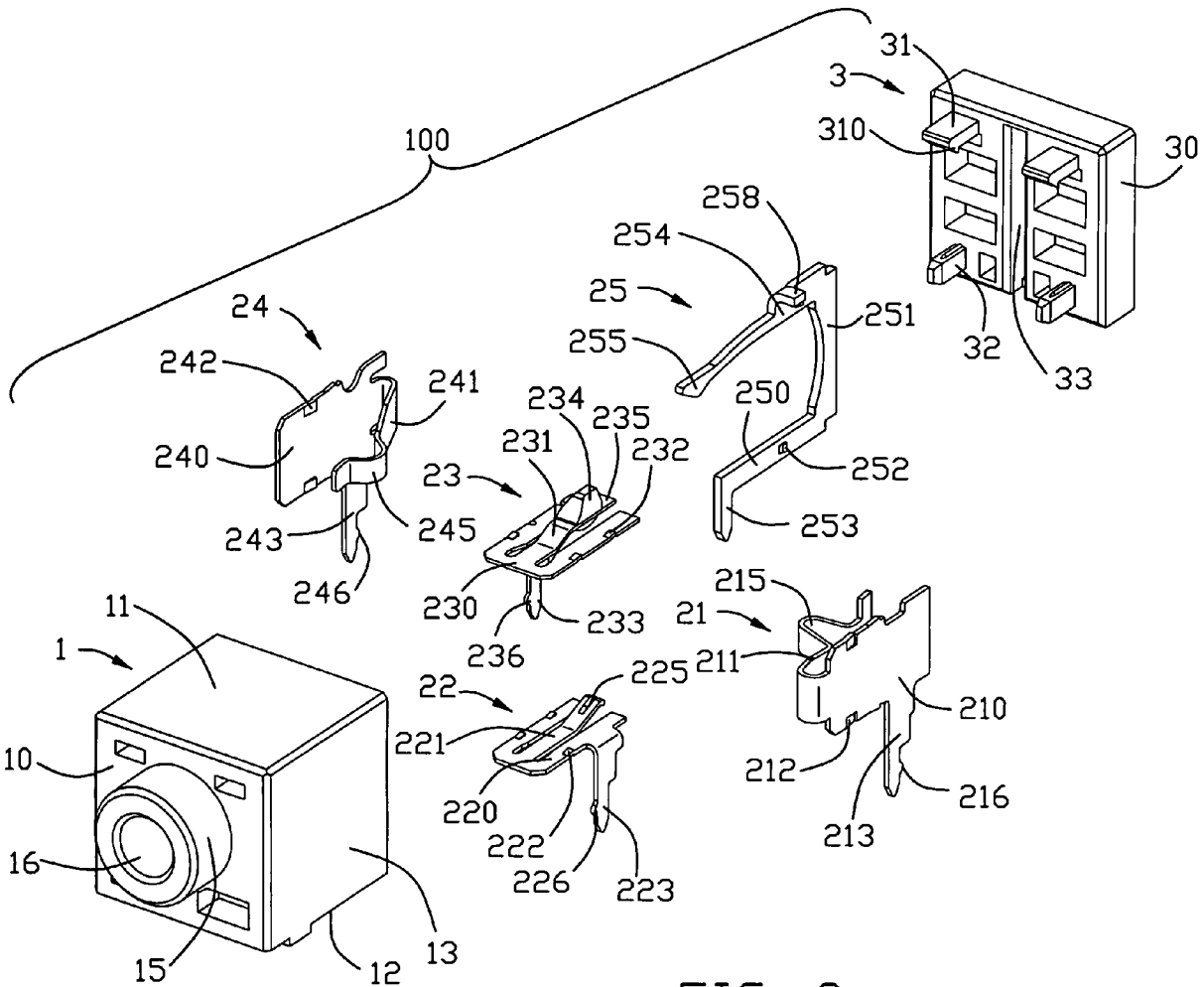
FIG. 3 is an exploded perspective view of the electrical connector shown in FIG. 1.
Figure 4:
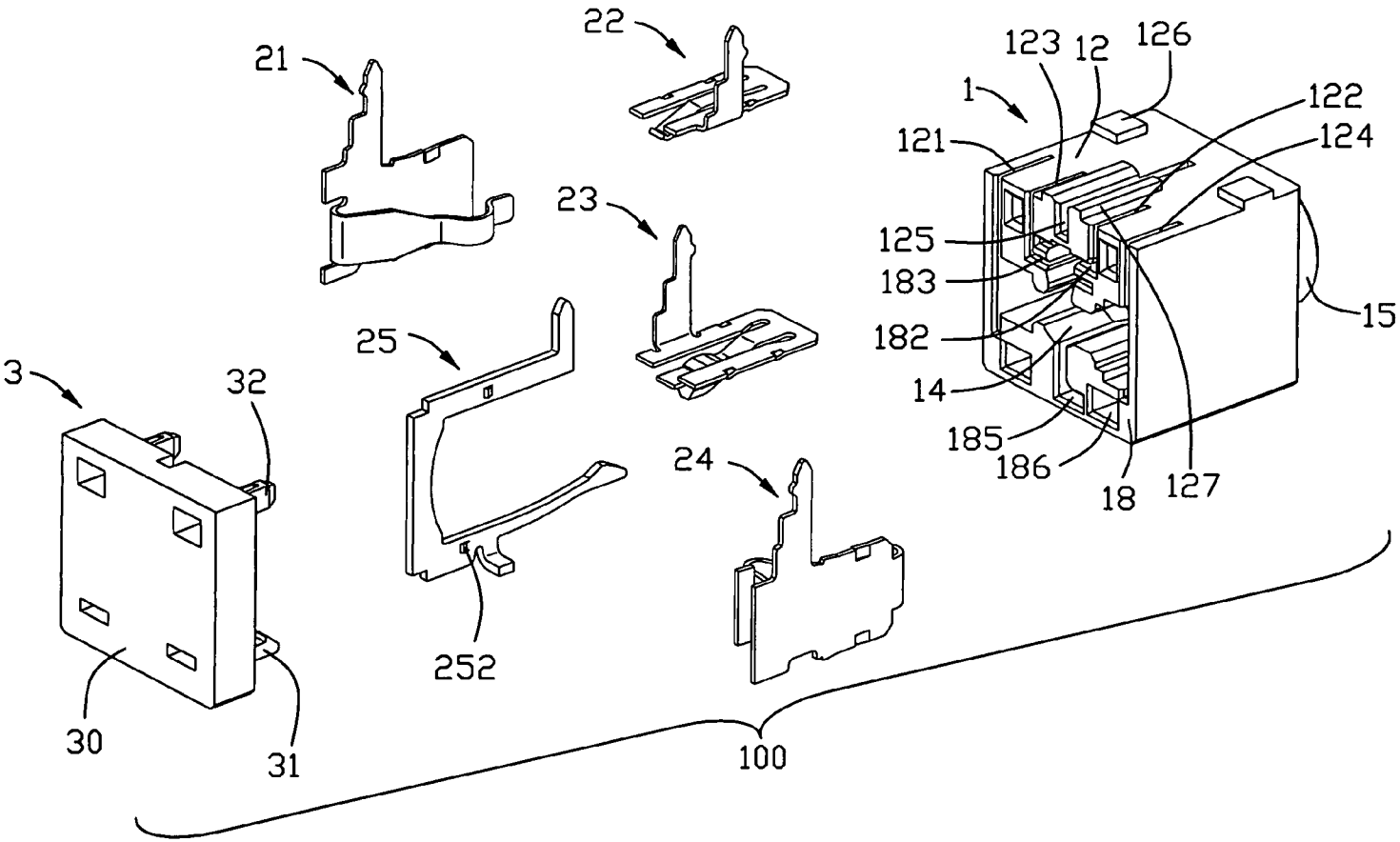
FIG. 4 is a view similar to FIG. 3, while taken from a different aspect.
Figure 5:
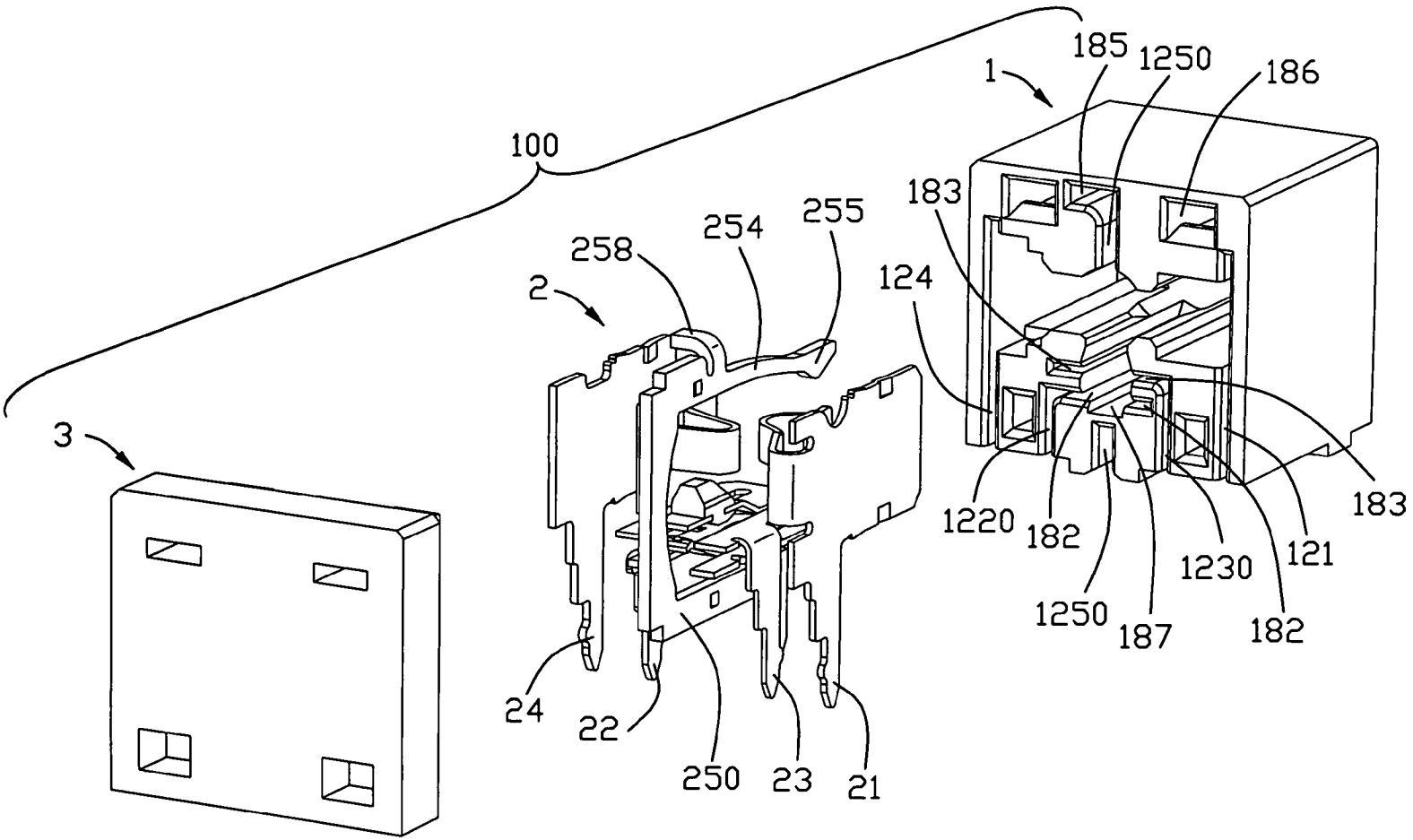
FIG. 5 is another exploded perspective view of the electrical connector.
Figure 6:
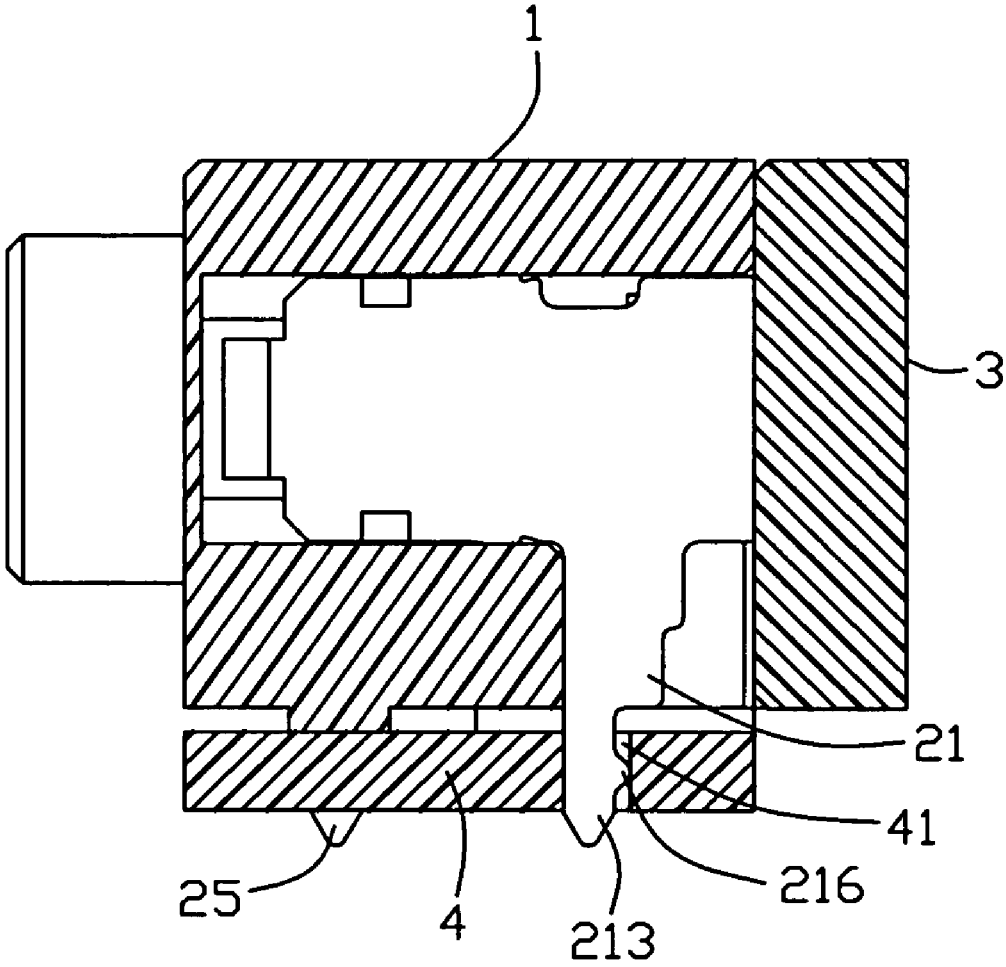
FIG. 6 is a cross-sectional view of the electrical connector taken along line 6-6 of FIG. 1 and being mounted on the printed circuit board.
Figure 7:
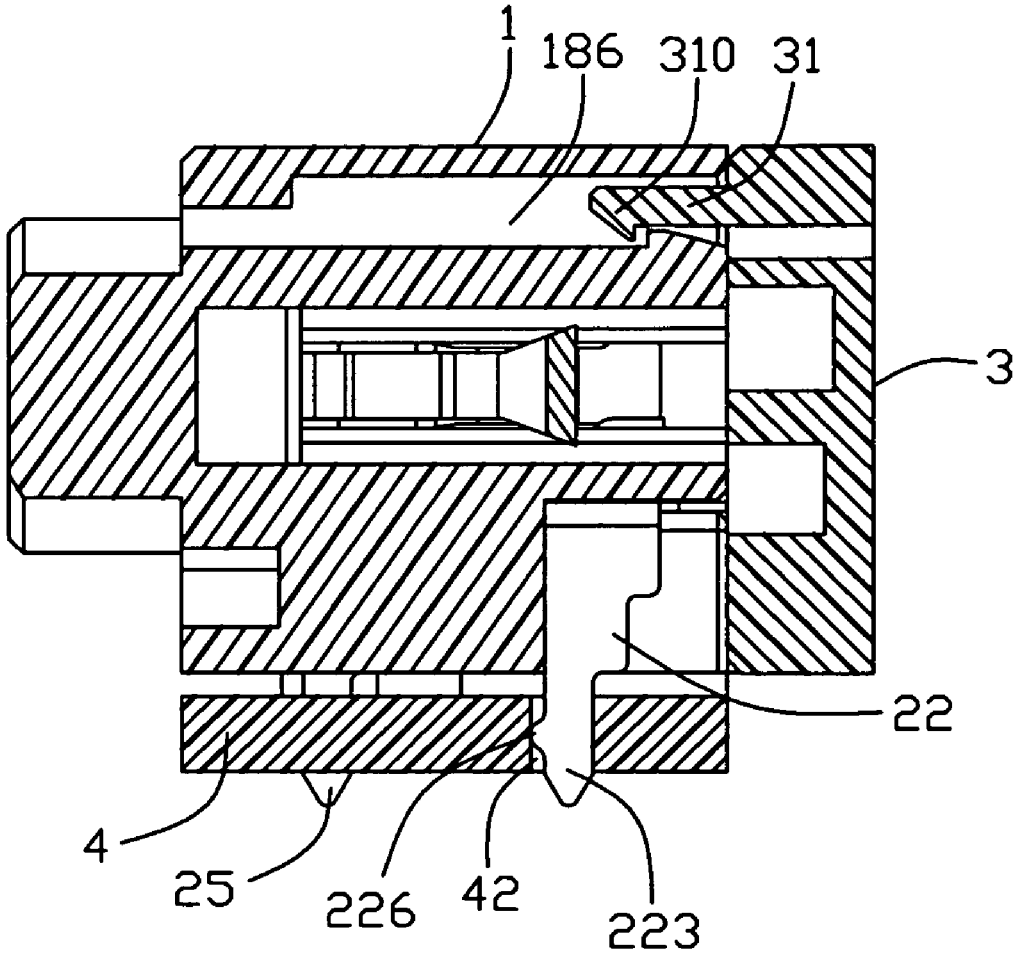
FIG. 7 is a cross-sectional view of the electrical connector taken along line 7-7 of FIG. 1 and being mounted on the printed circuit board.

Referring to FIGS. 1 and 2, an electrical connector 100, preferably an audio jack connector, comprises an insulative housing 1, a plurality of electrical contacts 2 and a cover 3 retained on a rear side of the housing 1.

The housing 1 has a rectangular body portion 10, a front column portion 15 extending from the body portion 10 and defining a front mating face 151, and a receiving cavity 16 extending therethrough for receiving a mating plug (not shown). The body portion 10 has a plurality of side walls 11, 12, 13. The cover 3 has a base plate 30 and four position tabs 31, 32 extending forwardly therefrom. A barb 310 is formed on a distal end of the position tab 31 to lock with the rectangular body portion 10. A plurality of position holes 186 are provided on a rear side of the body portion 10 to accommodate the position tabs 31, 32. The barbs 310 are interferentially fixed within the position holes 186 to attach the cover 3 to the housing 1.

The contacts 2 includes a first contact 21, a second contact 22, a third contact 23, a fourth contact 24, and a fifth contact 25. The first contact 21 and the fourth contact 24 are similar to each other and each comprises a vertical base portion 210, 240, a first soldering portion 213 and a fourth soldering portion 243 extending perpendicularly and downwardly from the base portion 210, 240 respectively, and a spring arm 211, 241 bent inwardly from one end of the base portion 210, 240. A contacting portion 215, 245 is provided on the spring arm 211, 241 to contact with the mating plug.

The second contact 22 and the third contact 23 constitute a switch to detect an insertion of the mating plug, and each includes a base portion 220, 230, a second soldering portion 223 and a third soldering portion 233 projecting perpendicularly and downwardly from the base portion 220, 230, a spring arm 221, 231 extending upwardly from a front end of the base portion 220, 230. A contacting portion 225, 235 is formed on the spring arm 221, 231 to contact with each other upon insertion of the mating plug. A plastic block 234 is attached to a free end of the spring arm 231 and is located above the contacting portion 235.

The fifth contact 25 is substantially U-shaped, comprises a fifth base portion 250, a fifth soldering portion 253 projecting perpendicularly and downwardly from one end of the fifth base portion 250, a transition arm 251 extending upwardly from the other end of the fifth base portion 250, a spring arm 254 extending forwardly from an upper end of the transition arm 251. A contacting portion 255 is formed on a distal end of the spring arm 254 to contact with the mating plug. The base plate 30 of the cover 3 defines a central slot 33 for receiving the transition arm 251. A retention arm 258 protrudes laterally from a substantially middle portion of the spring arm 254.

The housing 1 includes a first passageway 121, a second passageway 122, a third passageway 123, a fourth passageway 124, a fifth passageway 125 adapted to retain the first contact 21, the second contact 22, the third contact 23, the fourth contact 24, and the fifth contact 25 respectively, a plurality of barbs 212, 222, 232, 242, 252 are provided on the base portions 210, 220, 230, 240, 250 to interferentially engage with the first passageway 121, the second passageway 122, the third passageway 123, the fourth passageway 124, the fifth passageway 125 respectively. The second passageway 122, the third passageway 123 and the fifth passageway 125 includes a second vertical portion 1220, a third vertical portion 1230, a fifth vertical portion 1250 respectively to receive the soldering portion 223, 233, 253, and a second lateral portion 182 communicating with the second vertical portion 1220, a third lateral portion 183 communicating with third vertical portion 1230, a fifth lateral portion 185 communicating with the fifth vertical portion 1250 to retain the base portion 220, 230 and the retention arm 258 respectively. The housing 1 is provided with a separating wall 187 located beneath the second lateral portion 182. The separating wall 187 divides the fifth vertical portion 1250 into a lower portion to retain the base portion 250 and an upper portion communicating with the receiving cavity 16 to receive the spring arm 254.

In assembly, the first contact 21, the second contact 22, the third contact 23, the fourth contact 24, and the fifth contact 25 are inserted into the first passageway 121, the second passageway 122, the third passageway 123, the fourth passageway 124, the fifth passageway 125 from a rear side of the housing 1 in a rear-to-front direction respectively. The first contact 21 and the fourth contact 24 are substantially disposed on a left and a right side of the receiving cavity 16. The spring arm 254 is positioned on an upper side of the receiving cavity 16. The second contact 22 and the third contact 23 are located on a lower side of the receiving cavity 16. The contacting portions 215, 245, 255 and the plastic block 234 project into the receiving cavity 16 to connect with the mating plug. The separating wall 187 is located beneath the spring arm 221 to support the spring arm 221, therefore preventing the spring arm 221 from moving downwardly to contact with the base portion 250 upon insertion of the mating plug.

The electrical connector 100 is mounted onto a printed circuit board 4 comprising a first through hole 41, a second through hole 42, a third through hole 43, a fourth through hole 44 arranged in a first row and a fifth through hole 45 for receiving the first soldering portion 213, the second soldering portion 223, the third soldering portion 233, the fourth soldering portion 243, the fifth soldering portion 253 correspondingly. A first protrusion portion 216 projects from only one side edge of the first soldering portion 213 along a first direction. A second protrusion portion 226 projects from only one side edge of the second soldering portion 223 along a second direction opposite to the first direction. A third protrusion portion 236 projects from only one side edge of the third soldering portion 233 along the second direction. A fourth protrusion portion 246 projects from only one side edge of the fourth soldering portion 243 along the first direction.

The soldering portions 213, 223, 233, 243 can be made efficiently and arranged in the first row, and the fifth soldering portion 253 is located before the first row. When the soldering portions 213, 223, 233, 243, 253 are inserted into the corresponding through holes 41, 42, 43, 44, 45, the soldering portions 213, 223, 233, 243, 253 abut against opposite inner side walls of the corresponding through holes 41, 42, 43, 44, 45 and are retained on the printed circuit board 4 reliably, and finally soldered to the printed circuit board 4.

Figure 8:
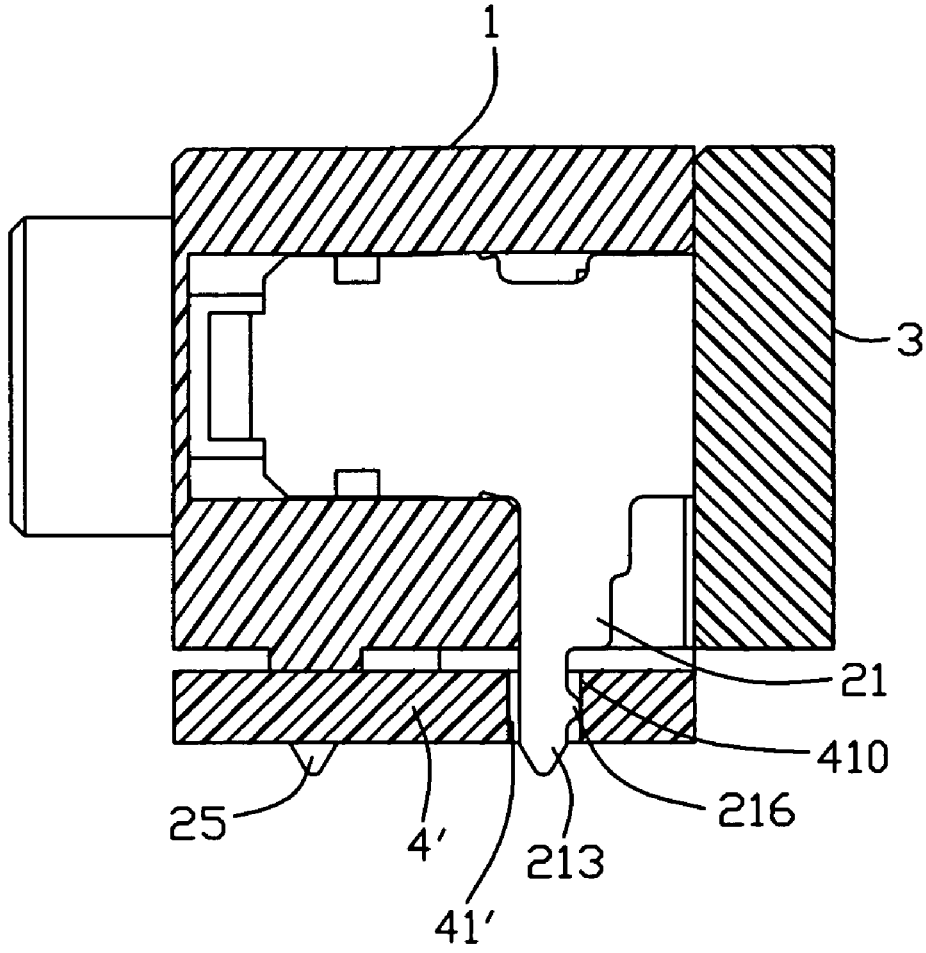
FIG. 8 is a view similar to FIG. 6, showing the electrical connector being mounted on an alternative printed circuit board.
Figure 9:
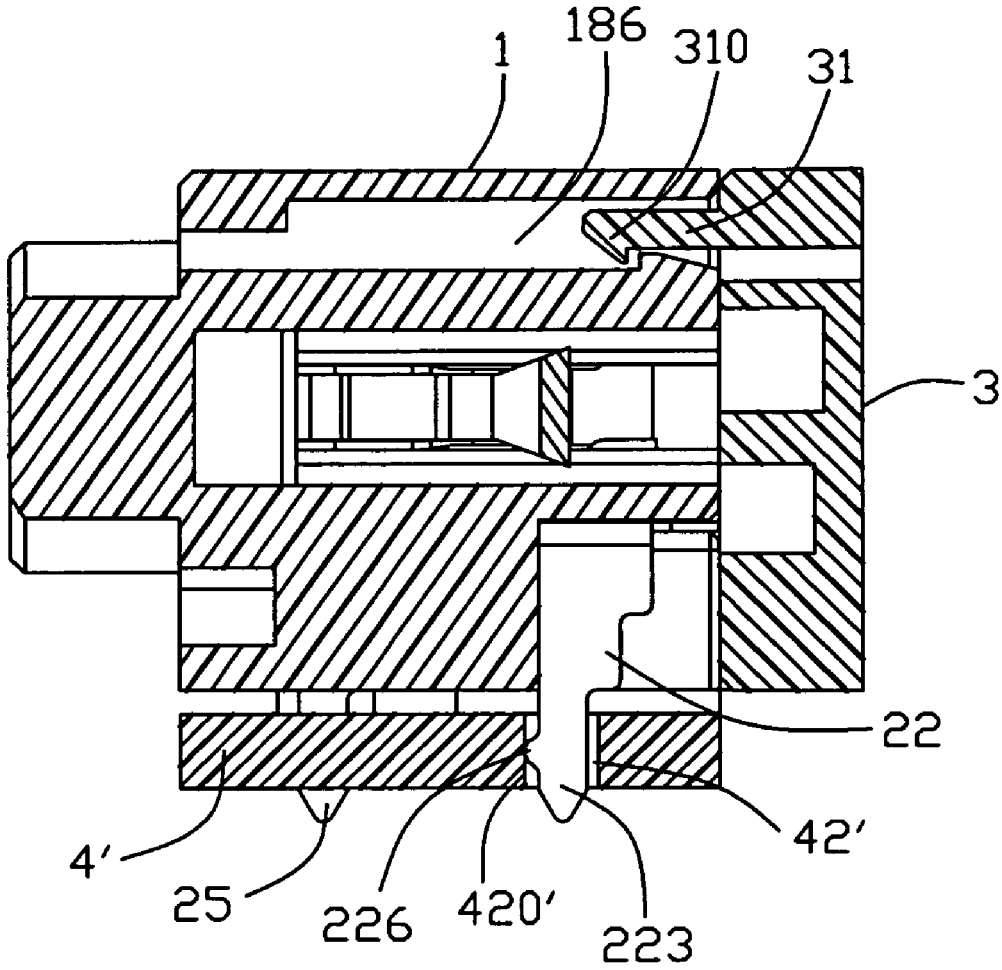
FIG. 9 is a view similar to FIG. 7, showing the electrical connector being mounted on the alternative printed circuit board.

Referring to FIGS. 8 and 9, the electrical connector 100 is mounted onto an alternative printed circuit board 4' comprising a first through hole 41', a second through hole 42', a third through hole, a fourth through hole and a fifth through hole (not shown). The through holes of the alternative printed circuit board 4' each has a larger dimension than the through holes 41, 42, 43, 44 in the longitudinal direction of the receiving cavity 16 and the soldering portions 213, 223, 233, 243. When the first soldering portion 213 is inserted into the first through hole 41', only the first protrusion portion 216 on one side edge of the first soldering portion 213 abuts against an inner side wall 410' of the through hole 41' in the first direction, accordingly, the inner side wall 410' exerts a first elastic force on the first soldering portion 213 in the second direction opposite to the first direction. When the second soldering portion 223 adjacent to the first soldering portion 213 is inserted into the second through hole 42', only the second protrusion portion 226 on one side edge of the first soldering portion 223 abuts against a second inner side wall 420' of the through hole 42' in the second direction, accordingly, the inner side wall 420' exerts a second elastic force on the second soldering portion 223 in the first direction.

The first protrusion portion 216 and the second protrusion portion 226 constitute a latch portion of the first soldering portion 213 and the second soldering portion 223. The first soldering portion 213 and the second soldering portion 223 bear elastic forces in opposite directions from the alternative printed circuit board 4', such that the first soldering portion 213 and the second soldering portion 223 are retained in the through holes 41', 42' via engagement between the latch portion and the through holes 41', 42' prior to soldering to the through holes 41', 42'.

Similarly, the third protrusion portion 236 and the fourth protrusion portion 246 constitute a locking portion of the third soldering portion 233 and the fourth soldering portion 243. The third soldering portion 233 and the fourth soldering portion 243 bear elastic forces in opposite directions from the alternative printed circuit board 4' such that the third soldering portion 233 and the fourth soldering portion 243 are retained in the third through hole and the fourth through hole via engagement between the locking portion and the third through hole and the fourth through hole prior to soldering to third through hole and the fourth through hole.

In use, the mating plug is inserted into the receiving cavity 16 to a predetermined depth, the contacting portions 215, 245, 255 contact with the mating plug, the plastic block 234 is deflected downwardly by the mating plug and actuates the spring arm 231 to move downwardly to establish an electrical connection between the contacting portions 225, 235, thereby making the switch closed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector mounted on a printed circuit board, comprising:

an insulative housing having a receiving cavity for receiving a mating plug and a plurality of passageways; and a plurality of contacts retained in the passageways respectively, including:

a first contact having a first base portion and a first soldering portion extending downwardly from the first base portion, the first soldering portion comprising a first protrusion portion projecting from only one side edge thereof in a first direction;

a second contact having a second base portion and a second soldering portion extending downwardly from the second base portion, the second soldering portion defining a second protrusion portion projecting from only one side edge thereof in a second direction opposite to the first direction;

wherein the first protrusion portion and the second protrusion portion together form a latch portion to fix the first contact and the second contact to the printed circuit board;

wherein a third contact having a third soldering portion and a fourth contact having a fourth soldering portion, the first soldering portion, the second soldering portion, the third soldering portion and the fourth soldering portion are arranged in a first row;

wherein a fifth contact including a fifth soldering portion which is located before the first row;

wherein the fifth contact defines a fifth base portion, a transition arm projecting upwardly from one end of the fifth base portion and a fifth spring arm extending forwardly from an upper end of the transition arm to be located above the fifth base portion, the fifth spring arm include a fifth contacting portion on a distal end thereof, the fifth contacting portion extends into the receiving cavity to contact with the mating plug.

2. The electrical connector as claimed in claim 1, wherein the third soldering portion includes a third protrusion portion projecting from only one side edge thereof in the second direction, and the fourth soldering portion defines a fourth protrusion portion projecting from only one side edge thereof in the first direction, the third protrusion portion and the fourth protrusion portion commonly define a locking portion to retain the third contact and the fourth contact to the printed circuit board.

3. The electrical connector as claimed in claim 1, wherein the second contact cooperates with the third contact to form a switch.

4. The electrical connector as claimed in claim 1, wherein the fifth spring arm defines a retention arm extending laterally from a substantially middle portion thereof, the passageways include a fifth passageway defining a vertical portion to retain the fifth base portion and a lateral portion to fix the retention arm.

5. The electrical connector as claimed in claim 4, wherein the housing defines a separating wall to divide the vertical portion of the fifth passageway into an upper portion communicating with the receiving cavity to receive the fifth spring arm and a lower portion to retain the fifth base portion.

6. The electrical connector as claimed in claim 1, further comprising a cover attached to a rear side of the housing, the cover defines a plurality of position tabs, the housing includes a plurality of position holes to lock with the corresponding position tabs.

7. The electrical connector as claimed in claim 6, wherein the cover defines a central slot on an inner side thereof to receive the transition arm of the fifth contact.

8. An electrical connector assembly, comprising:

a printed circuit board defining a plurality of through holes including a first through hole and a second through hole;

an insulative housing having a receiving cavity extending therethrough for receiving a mating plug and a plurality of passageways communicating with the receiving cavity;

a plurality of contacts received in the corresponding passageways, including:

a first contact defining a first base portion, a first contacting portion extending from the first base portion, a first soldering portion projecting downwardly from the first base portion and including a first protrusion portion protruding from only one side edge thereof in a first direction;

a second contact defining a second base portion, a second contacting portion extending from the second base portion, a second soldering portion projecting downwardly from the second base portion and including a second protrusion portion protruding from only one side edge thereof in a second direction opposite to the first direction;

wherein the through holes each has a larger dimension than the first soldering portion and the second soldering portion, the first protrusion portion is received in the first through hole and abuts against an inner side wall of the first through hole in the first direction, the second protrusion portion is received in the second through hole and abuts against an inner side wall of the second through hole in the second direction, the first protrusion portion and the second protrusion portion constitute a latch portion to fix the first contact and the second contact to the printed circuit board;

wherein the through holes further comprise a third through hole, a fourth through hole and a fifth through hole, the first through hole, the second through hole, the third through hole and the fourth through hole are arranged in a first row, the contacts further comprise a third contact defining a third soldering portion received in the third through hole, a fourth contact defining a fourth soldering portion disposed in the fourth through hole, and a fifth contact defining a fifth soldering portion received in the fifth soldering hole;

wherein the passageways include a first passageway to receive the first contact, a second passageway to receive the second contact, a third passageway to receive the third contact, a fourth passageway to receive the third contact and a fifth passageway to receive the fifth contact;

wherein the fifth contact has a fifth base portion, a transition arm extending upwardly from one end of the fifth base portion, a spring arm extending forwardly from an upper end of the transition arm and a retention arm projecting laterally from the spring arm, the fifth passage includes a fifth lateral portion to retain the retention arm and a fifth vertical portion communicating with the fifth lateral portion to receive the spring arm and the fifth base portion.

9. The electrical connector assembly as claimed in claim 8, wherein the housing further comprises a separating wall to divide the fifth vertical portion into an upper portion to receive the spring arm and a lower portion to retain the fifth base portion, the separating wall abuts against the second contacting portion when the third contact moves downwardly to contact the second contacting portion.

* * * * *